US007945203B2

(12) United States Patent
Shimizu et al.

(10) Patent No.: US 7,945,203 B2
(45) Date of Patent: May 17, 2011

(54) WASTE-TONER COLLECTING DEVICE, PROCESS CARTRIDGE, AND IMAGE FORMING APPARATUS

(75) Inventors: Yoshiyuki Shimizu, Hyogo (JP); Kenzo Tatsumi, Osaka (JP); Hirobumi Ooyoshi, Osaka (JP); Yoshihiro Kawakami, Hyogo (JP); Tomofumi Yoshida, Osaka (JP); Tomohiro Kubota, Osaka (JP); Kazuyoshi Kondo, Osaka (JP); Yutaka Naitoh, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 173 days.

(21) Appl. No.: 12/333,201

(22) Filed: Dec. 11, 2008

(65) Prior Publication Data

US 2009/0154973 A1 Jun. 18, 2009

(30) Foreign Application Priority Data

Dec. 17, 2007 (JP) ..... 2007-324139
Oct. 20, 2008 (JP) ..... 2008-269284

(51) Int. Cl.
*G03G 21/12* (2006.01)
*G03G 21/00* (2006.01)

(52) U.S. Cl. ..... 399/360; 399/358

(58) Field of Classification Search ..... 399/358, 399/359, 360
See application file for complete search history.

(56) References Cited

U.S. PATENT DOCUMENTS 5,956,556 A * 9/1999 Nakajima et al. ..... 399/359
7,107,002 B2 * 9/2006 Saito et al. ..... 399/360
7,366,440 B2 * 4/2008 Horikawa ..... 399/358 X
2007/0104523 A1 5/2007 Yoshida et al.
2007/0140763 A1 6/2007 Shimizu et al.
2007/0248390 A1 10/2007 Kubota et al.
2008/0019720 A1 1/2008 Kawakami et al.
2008/0089727 A1 4/2008 Shimizu et al.
2008/0095559 A1 4/2008 Shimizu et al.
2008/0145108 A1 6/2008 Yoshida et al.
2008/0145109 A1 6/2008 Murayama et al.
2008/0145119 A1 6/2008 Tatsumi et al.
2008/0152408 A1 6/2008 Kawakami et al.
2008/0170898 A1 7/2008 Shimizu et al.
2008/0181692 A1 7/2008 Tatsumi et al.
2008/0187358 A1 8/2008 Kubota et al.
2008/0205930 A1 8/2008 Kawakami et al.
2008/0219698 A1 9/2008 Shimizu et al.
2008/0267661 A1 10/2008 Yoshida et al.
2008/0279581 A1 11/2008 Shimizu
2008/0279586 A1 11/2008 Tatsumi et al.

FOREIGN PATENT DOCUMENTS

CN 1987683 A 6/2007
JP 11-327397 11/1999
JP 2006-343371 A 12/2006
JP 2007-127845 5/2007

* cited by examiner

*Primary Examiner* — Sandra L Brase
(74) *Attorney, Agent, or Firm* — Dickstein Shapiro LLP

(57) ABSTRACT

A waste-toner collecting device includes a cleaning unit that collects waste toner remaining on an image carrier; a conveying belt that conveys the waste toner collected by the cleaning unit in a first direction; and a conveying screw that conveys the waste toner conveyed by the conveying belt in a second direction. An end of the conveying screw on a side of the conveying belt is rotatably supported by an inner wall of a body of the waste-toner collecting device in a state where the end of the conveying screw is in contact with the inner wall.

10 Claims, 14 Drawing Sheets

WASTE-TONER COLLECTING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document 2007-324139 filed in Japan on Dec. 17, 2007 and Japanese priority document 2008-269284 filed in Japan on Oct. 20, 2008.

BACKGROUND OF THE INVENTION

1. Field of the Invention

The present invention relates to a technology for collecting waste toner in an image forming apparatus.

2. Description of the Related Art

Replacement of consumables or maintenance of image forming apparatuses, which used to be performed by a service staff, are performed by the users of the apparatuses these days. This is because the image forming apparatuses have been made smaller than ever before. As a result, the number of components used in the image forming apparatuses have been minimized, and the users are forced to replace components having a relatively short useful life, such as a waste-toner container, by themselves at regular intervals. The waste-toner container is used to accumulate transfer residual toner, paper dust, and the like. If one would like to get rid of the need to replace the waste-toner container, then it will be necessary to mount a sufficiently large waste-toner container that could accommodate amounts of waste toner and the like for the entire life of the image forming apparatus, which results in an increase in the overall size of the apparatus undesirably.

Image forming apparatuses capable of reusing waste toner have been developed. Such image forming apparatuses are advantageous in that reuse of the waste toner results in saving of resources. However, this type of image forming apparatuses are relatively bulkier for various reasons. For example, it is necessary to provide a waste-toner collecting path in the apparatus. Moreover, the waste toner is contaminated by paper dust generated from transfer paper, so that to collect the waste toner properly, it is necessary to provide a screw for conveying the waste toner, a component for collecting the waste toner smoothly, and the like. Therefore, there has been expected to develop a waste-toner container having a longer useful life while reducing the number of components to prevent the apparatus from growing in size.

For example, Japanese Patent Application Laid-open No. H11-327397 discloses a technique for collecting waste toner in a waste-toner container. Specifically, an image forming apparatus disclosed in Japanese Patent Application Laid-open No. H11-327397 includes an image carrier; a cleaning unit that cleans a surface of the image carrier; a cleaner case in which waste toner collected by the cleaning unit is conveyed; a waste-toner conveying screw that conveys the waste toner; and a striking member that applies an impact force to the cleaner case or the waste-toner conveying screw. The striking member is configured to apply an impact force to the cleaner case or the waste-toner conveying screw while any toner image is not formed on the image carrier. In accordance with rotation of the waste-toner conveying screw, an elastic protrusion formed on the striking member has pulse-contact with the waste-toner conveying screw, whereby the waste-toner conveying screw receives a vibration. Therefore, it is possible to prevent toner from accumulating at a location where the toner is relatively prone to accumulate, for example, a gap between a tip portion of the waste-toner conveying screw in a conveying direction and a wall of a waste-toner collecting device. Consequently, it is possible to prevent occurrence of a conveying error of the waste toner.

However, even with the use of the above technique, the image forming apparatus cannot be sufficiently downsized because of the need to provide the striking member. Furthermore, it is not preferable to apply an impact force to the component. In most cases the image forming apparatus is installed near a personal computer, so that it is necessary that the image forming apparatus be less noisy so as not to annoy the user of the personal computer.

SUMMARY OF THE INVENTION

It is an object of the present invention to at least partially solve the problems in the conventional technology.

According to an aspect of the present invention, there is provided a waste-toner collecting device including a cleaning unit that collects waste toner remaining on an image carrier; a conveying belt that conveys the waste toner collected by the cleaning unit in a first direction; and a conveying screw that conveys the waste toner conveyed by the conveying belt in a second direction. An end of the conveying screw on a side of the conveying belt is rotatably supported by an inner wall of a body of the waste-toner collecting device in a state where the end of the conveying screw is in contact with the inner wall.

According to another aspect of the present invention, there is provided a process cartridge including the above waste-toner collecting device.

According to still another aspect of the present invention, there is provided an image forming apparatus including the above waste-toner collecting device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. However, the present invention is not limited to the embodiments.

Figure 1:
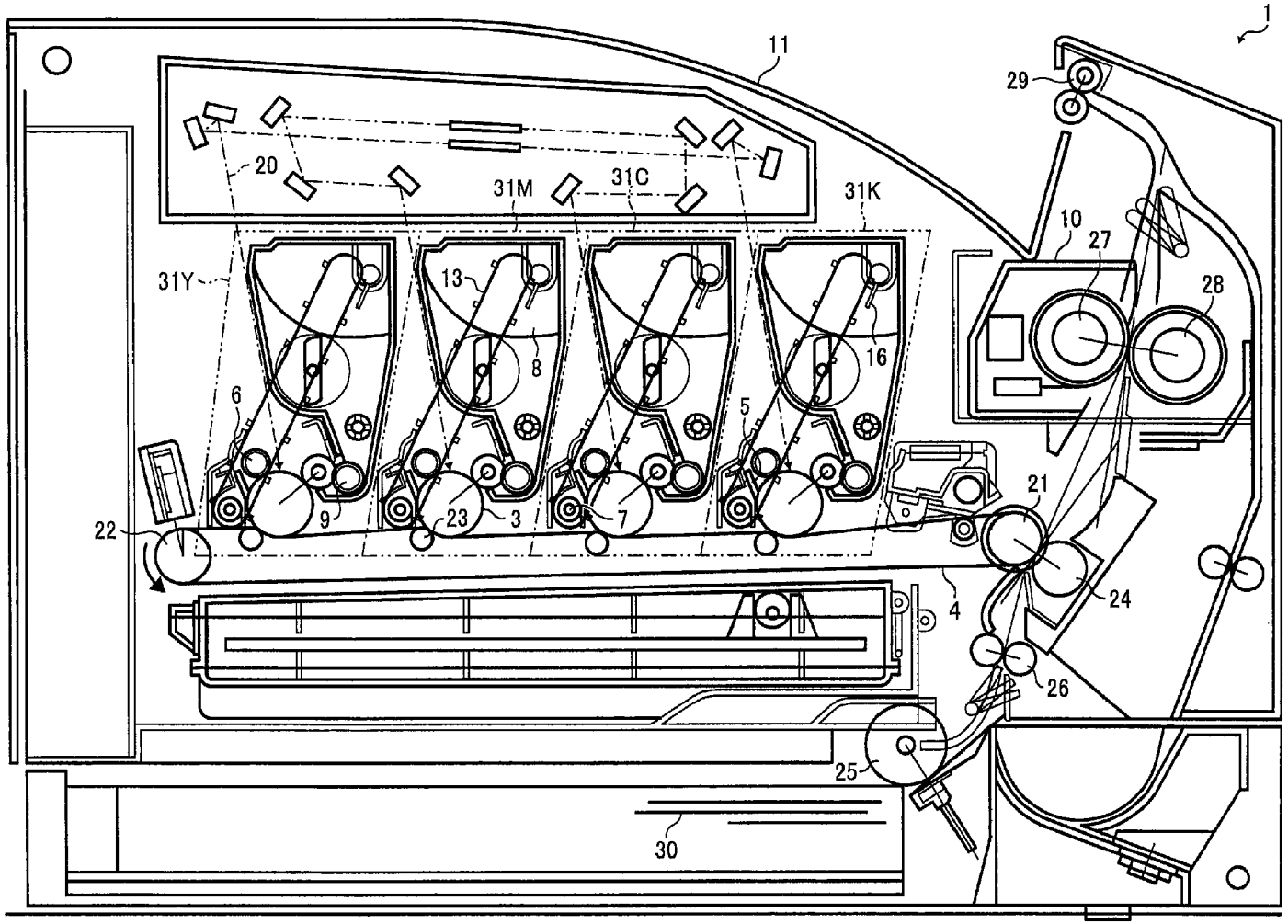
FIG. 1 is a schematic diagram of an image forming apparatus including a waste-toner collecting device according to a first embodiment of the present invention.

FIG. 1 is a schematic diagram of an image forming apparatus 1 including a waste-toner collecting device according to a first embodiment of the present invention. First, main elements of the image forming apparatus 1 are explained below. The image forming apparatus 1 includes four process units 31Y, 31M, 31C, and 31K, an intermediate transfer belt 4, a drive roller 21, a driven roller 22, and four primary transfer rollers 23, a secondary transfer roller 24, a sheet feed roller 25, a pair of conveying rollers 26, a fixing unit 10, a discharge unit 11, and a pair of discharge rollers 29.

Figure 2:
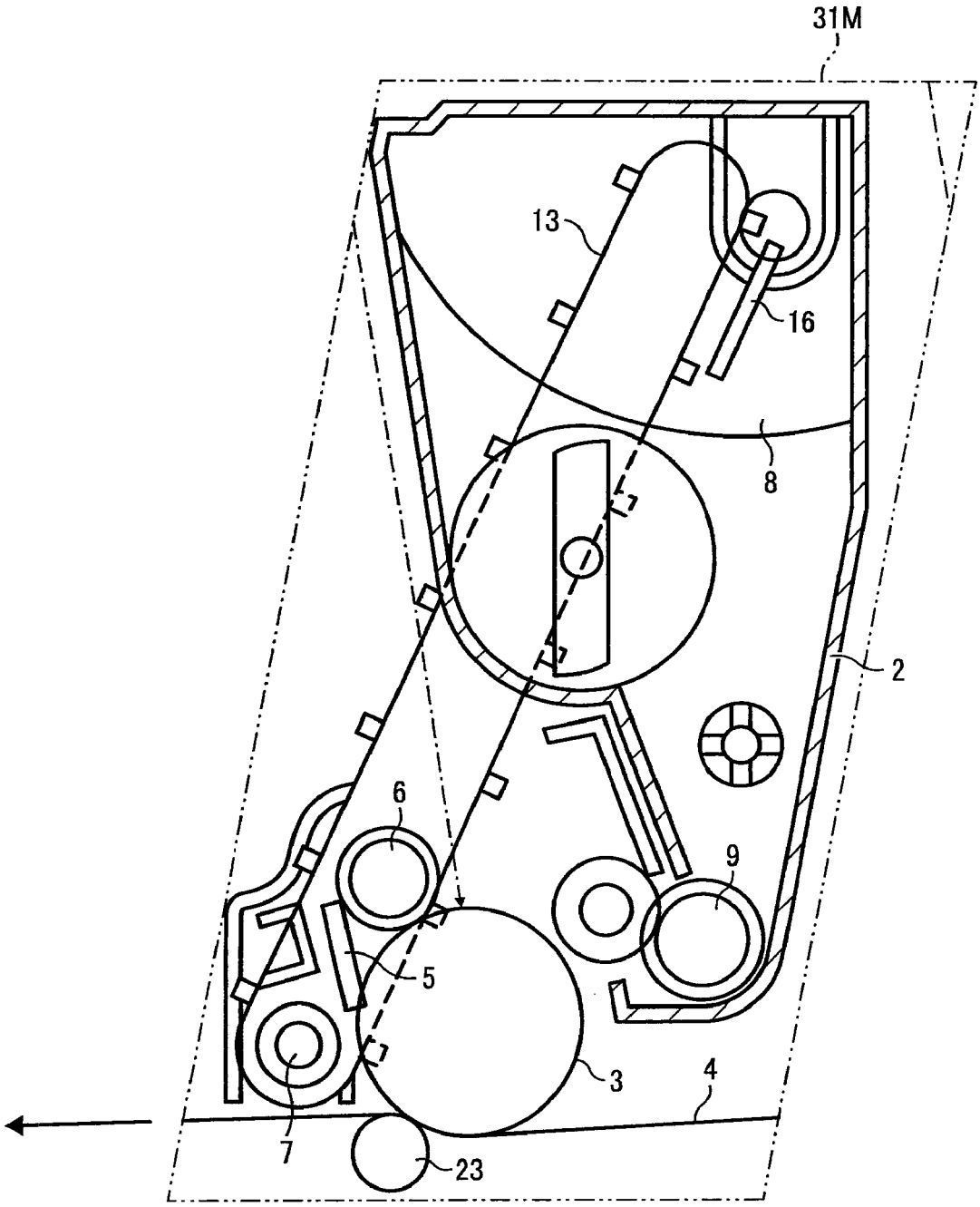
FIG. 2 is an enlarged view of a process unit shown in FIG. 1.

The process units 31Y, 31M, 31C, and 31K form yellow (Y), magenta (M), cyan (C), and black (K) toner images respectively. The process units 31Y, 31M, 31C, and 31K have the same configuration except for a color of toner used in each of the process units. FIG. 2 is an enlarged view of the process unit 31M as an example of all the process units. As shown in FIG. 2, each of the process units 31Y, 31M, 31C, and 31K includes a developing unit 2, an image carrier 3, a cleaning unit (a cleaning blade) 5, a charging roller 6, lower and upper waste-toner conveying screws 7, a waste-toner conveying belt 13, and a waste-toner container 8. The developing units 2 included in the process units 31Y, 31M, 31C, and 31K contain therein developers containing Y, M, C, and K toners, respectively. The developing unit 2 includes a developing roller 9. The image carrier 3 is arranged adjacent to the developing unit 2. The cleaning unit 5 is arranged on the image carrier 3. After a toner image formed on the image carrier 3 is transferred onto the intermediate transfer belt 4 as a transfer medium, the cleaning unit 5 collects a residual toner remaining on the image carrier 3 (hereinafter, "waste toner"). The charging roller 6 is arranged on the image carrier 3, and it electrically charges the image carrier 3. The waste toner collected by the cleaning unit 5 is conveyed in a horizontal direction by the lower waste-toner conveying screw 7, and put on the waste-toner conveying belt 13. The waste toner is conveyed upward by the waste-toner conveying belt 13, and collected in the waste-toner container 8. The waste-toner container 8 is made of hard resin. The waste-toner container 8 is removably attached to a main body of the image forming apparatus 1 so that it can be replaced with the new one when it gets full.

As shown in FIG. 1, the intermediate transfer belt 4 is an endless belt, and is supported by the drive roller 21, the driven roller 22, and the primary transfer rollers 23.

A process of transferring Y, M, C, and K toner images onto the intermediate transfer belt 4 is explained below. A bias supply (not shown) applies a voltage to a cored bar of the developing roller 9 to which the developer is attached. Furthermore, a bias supply (not shown) applies a voltage to the charging roller 6.

While the voltage is applied to the developing roller 9 and the charging roller 6, the image carrier 3 rotates at constant speed. After a previous transfer process is complete, waste toner on the image carrier 3 is cleaned by the cleaning unit 5. Then, the image carrier 3 is uniformly charged at high electric potential by the charging roller 6 located on the downstream side of the cleaning unit 5 in a rotating direction of the image carrier 3, and thereby being initialized. After that, the image carrier 3 is exposed to a laser beam 20 on the downstream side of the charging roller 6. Specifically, a surface of the image carrier 3 uniformly-charged at the high electric potential is selectively exposed to the laser beam 20 corresponding to image data, whereby an electrostatic latent image is formed on the surface of the image carrier 3. Namely, at this time, the surface of the image carrier 3 is composed of a low potential portion where the electric potential is attenuated due to the exposure and a high potential portion where the high electric potential due to the initialization remains. Toner contained in the developer attached to the developing roller 9 is transferred onto either the low potential portion or the high potential portion, whereby the electrostatic latent image is developed into a toner image. Then, the toner image is transferred onto the intermediate transfer belt 4.

At a timing of transferring the toner image onto the intermediate transfer belt 4, in the adjacent process unit, an electrostatic latent image formed on the image carrier 3 is developed into a toner image in the same manner as described above. The toner image is transferred onto the intermediate transfer belt 4 so as to be superimposed on the previously-transferred toner image. Such a process is sequentially performed in the other process units, and thereby forming a superimposed four-color toner image on the intermediate transfer belt 4. When the superimposed four-color toner image on the intermediate transfer belt 4 comes to a secondary nip portion formed between the drive roller 21 and the secondary transfer roller 24 in accordance with the movement of the intermediate transfer belt 4, the four-color toner image is transferred onto a sheet 30 by passing through the secondary nip portion, whereby a full-color image is formed on the sheet 30. Incidentally, the sheet 30 is fed by the sheet feed roller 25, and conveyed to the secondary nip portion by the conveying rollers 26. The sheet 30 on which the full-color image is formed is conveyed to the fixing unit 10. The fixing unit 10 includes a fixing roller 27 and a pressure roller 28. When the sheet 30 passes through a nip portion formed between the fixing roller 27 and the pressure roller 28, the full-color image is fixed on the sheet 30 by the application of heat and pressure. After that, the sheet 30 is discharged onto the discharge unit 11 formed on top of the image forming apparatus 1 by the discharge rollers 29. Incidentally, after the four-color toner image is transferred onto the sheet 30, residual toners remaining on the intermediate transfer belt 4 are cleaned by a belt cleaning blade (not shown) having contact with the intermediate transfer belt 4.

In the present embodiment, as shown in FIG. 1, the process units 31Y, 31M, 31C, and 31K are arranged in this order so that the process unit 31K is located on the side of the secondary nip portion. Furthermore, the process units 31Y, 31M, 31C, and 31K are arranged on a slant so that the side of the process unit 31Y is located lower than the side of the process unit 31K. This is because a monochrome image is formed more often than a color image. In other words, when a monochrome image is formed, only the process unit 31K is used.

Therefore, to shorten a print time, the process units 31Y, 31M, 31C, and 31K are arranged as described above.

Figure 3:
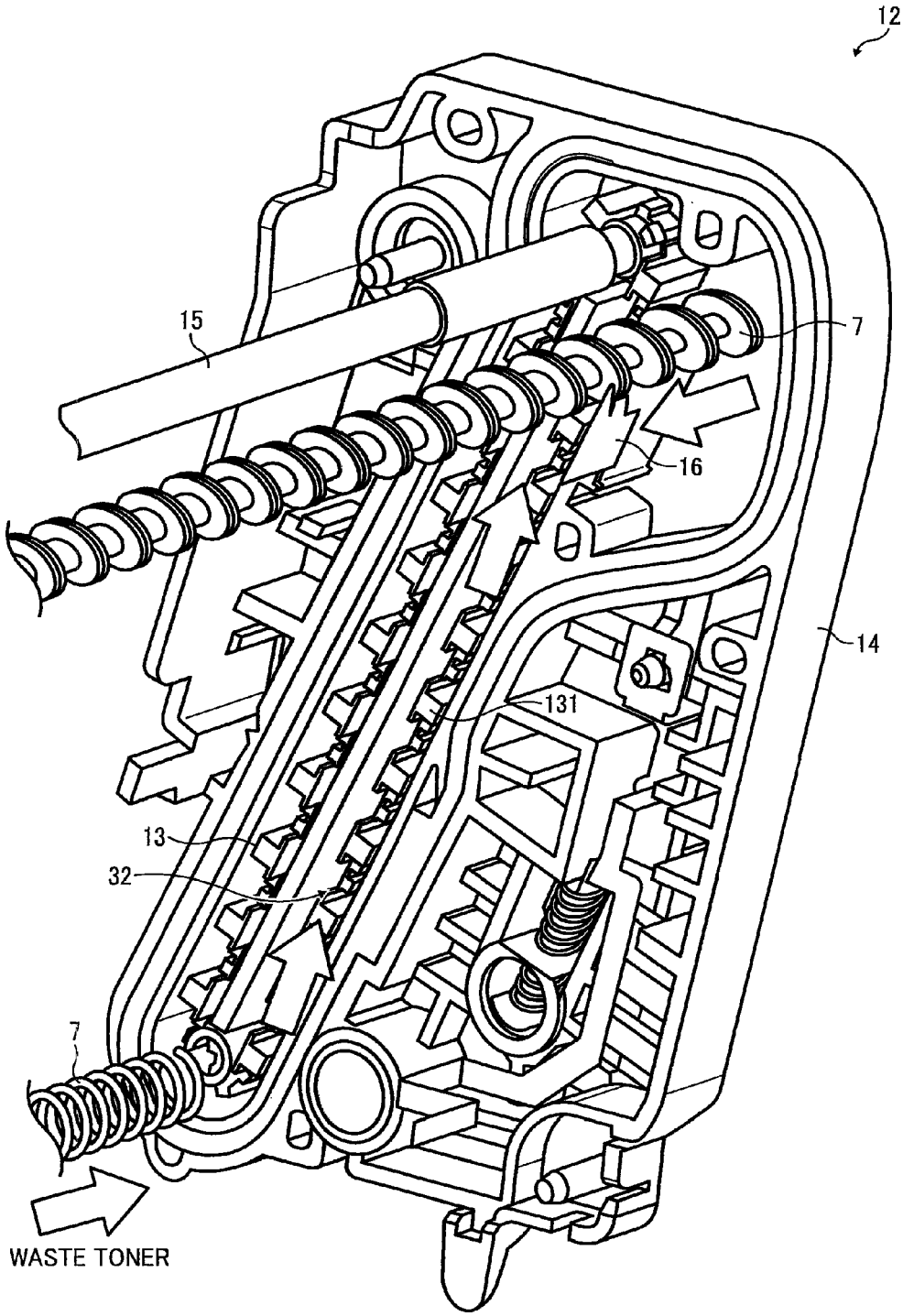
FIG. 3 is a perspective view of the waste-toner collecting device included in the process unit shown in FIG. 2.

FIG. 3 depicts a configuration of a waste-toner collecting device 12 according to the first embodiment of the present invention. The waste-toner collecting device 12 includes the lower and upper waste-toner conveying screws 7, the waste-toner conveying belt 13, the waste-toner container 8 (not shown in FIG. 3), a toner collecting path 32, and a toner scraping member 16.

The waste-toner collecting device 12 is included in each of the process units 31Y, 31M, 31C, and 31K, and collects waste toner from the image carrier 3 (see FIGS. 1 and 2). Specifically, the waste toner collected from the image carrier 3 is conveyed in the horizontal direction by the lower waste-toner conveying screw 7, and put on the waste-toner conveying belt 13 being driven to move. The waste toner is conveyed upward in accordance with the movement of the waste-toner conveying belt 13. More specifically, convex portions 131 are formed on the waste-toner conveying belt 13, and the waste toner is conveyed upward in the gap between the convex portions 131 and a wall of the toner collecting path 32. When the waste toner is conveyed to the upper waste-toner conveying screw 7, the waste toner is collected in the waste-toner container 8 by the upper waste-toner conveying screw 7. Incidentally, it is preferable that a waste-toner conveying capacity of the waste-toner conveying belt 13 shown in FIG. 2 is larger than a waste-toner conveying collecting capacity of the cleaning unit 5 shown in FIG. 1. This is to prevent the collected waste toner exceeding a capacity of the toner collecting path 32.

One end of the upper waste-toner conveying screw 7 on the side of the waste-toner conveying belt 13 is rotatably supported by an inner wall of a body 14 of the waste-toner collecting device 12 in a state where the end of the upper waste-toner conveying screw 7 is in contact with the inner wall of the body 14. In other words, there is no gap between the end of the upper waste-toner conveying screw 7 and the inner wall of the body 14. Therefore, it is possible to solve the conventional problem that waste toner is prone to accumulate in the gap the end of the upper waste-toner conveying screw 7 and the inner wall of the body 14. Thus, it is possible to prevent waste toner from accumulating in the gap between the end of the upper waste-toner conveying screw 7 and the inner wall of the body 14 without increasing a size of the waste-toner collecting device 12 or applying an impact force to the waste-toner collecting device 12. Furthermore, to improve the efficiency of the delivery of the waste toner, an axial center of a drive shaft of the upper waste-toner conveying screw 7 is set to be located lower than an axial center of a drive shaft 15 of the waste-toner conveying belt 13. The drive shaft 15 is provided on the upper side of the waste-toner conveying belt 13.

Figure 4:
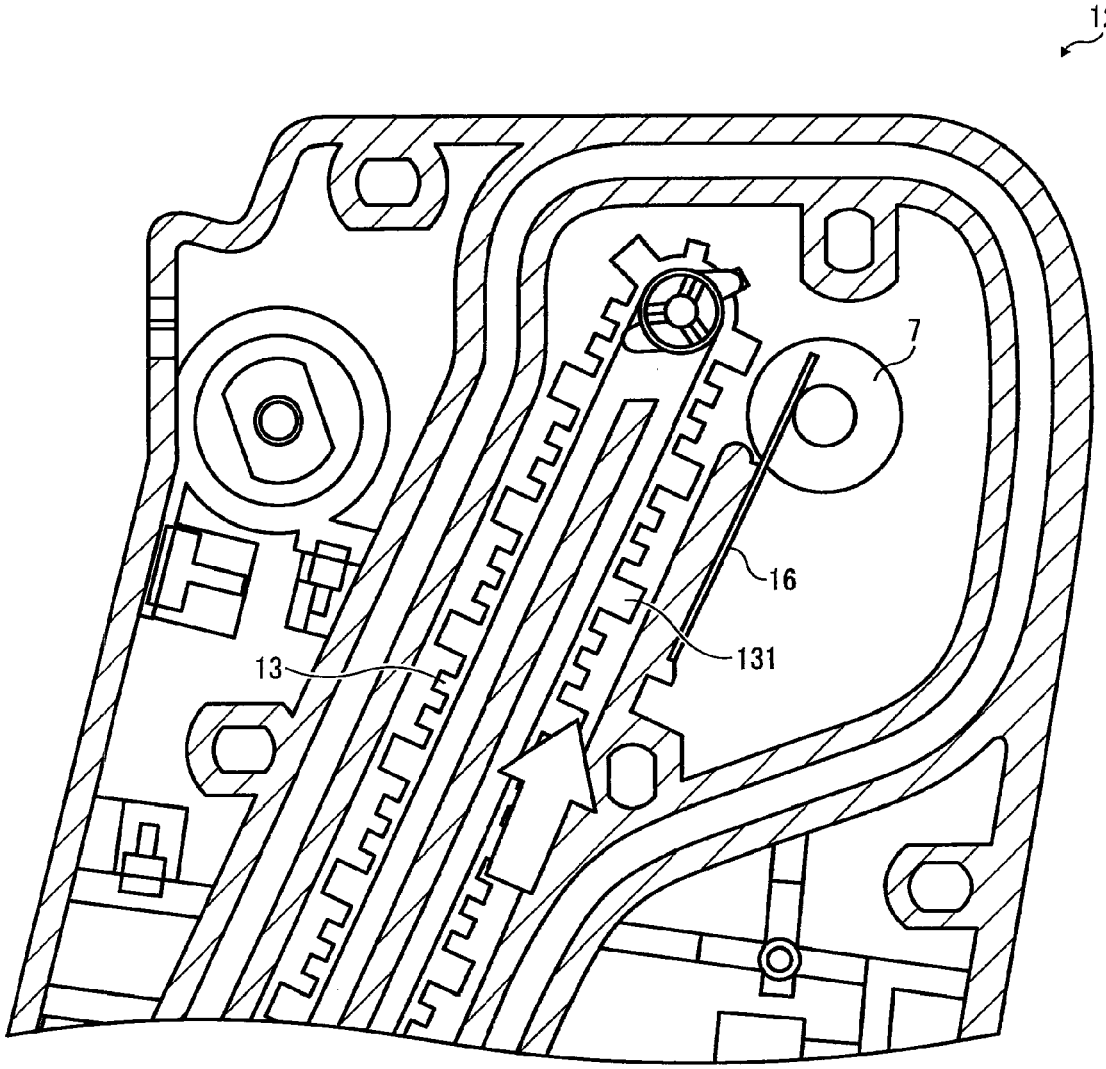
FIG. 4 is a partial cross-sectional view of the waste-toner collecting device shown in FIG. 3.

FIG. 4 is a partial cross-sectional view of the waste-toner collecting device 12 shown in FIG. 3. As described above, the waste toner conveyed on the waste-toner conveying belt 13 is further conveyed by the upper waste-toner conveying screw 7, and collected in the waste-toner container 8 (see FIG. 2). However, when toner degrades with long-term use, the toner is prone to be stuck on the waste-toner conveying screw 7, and thus the waste-toner conveying screw 7 may decrease in performance of conveying the toner. To overcome this problem, the toner scraping member 16 is provided near a position where the waste-toner conveying screw 7 is close to the waste-toner conveying belt 13. The toner scraping member 16 is arranged to be at right angle to the waste-toner conveying screw 7. The toner scraping member 16 scrapes off toner stuck on the waste-toner conveying screw 7.

Figure 5:
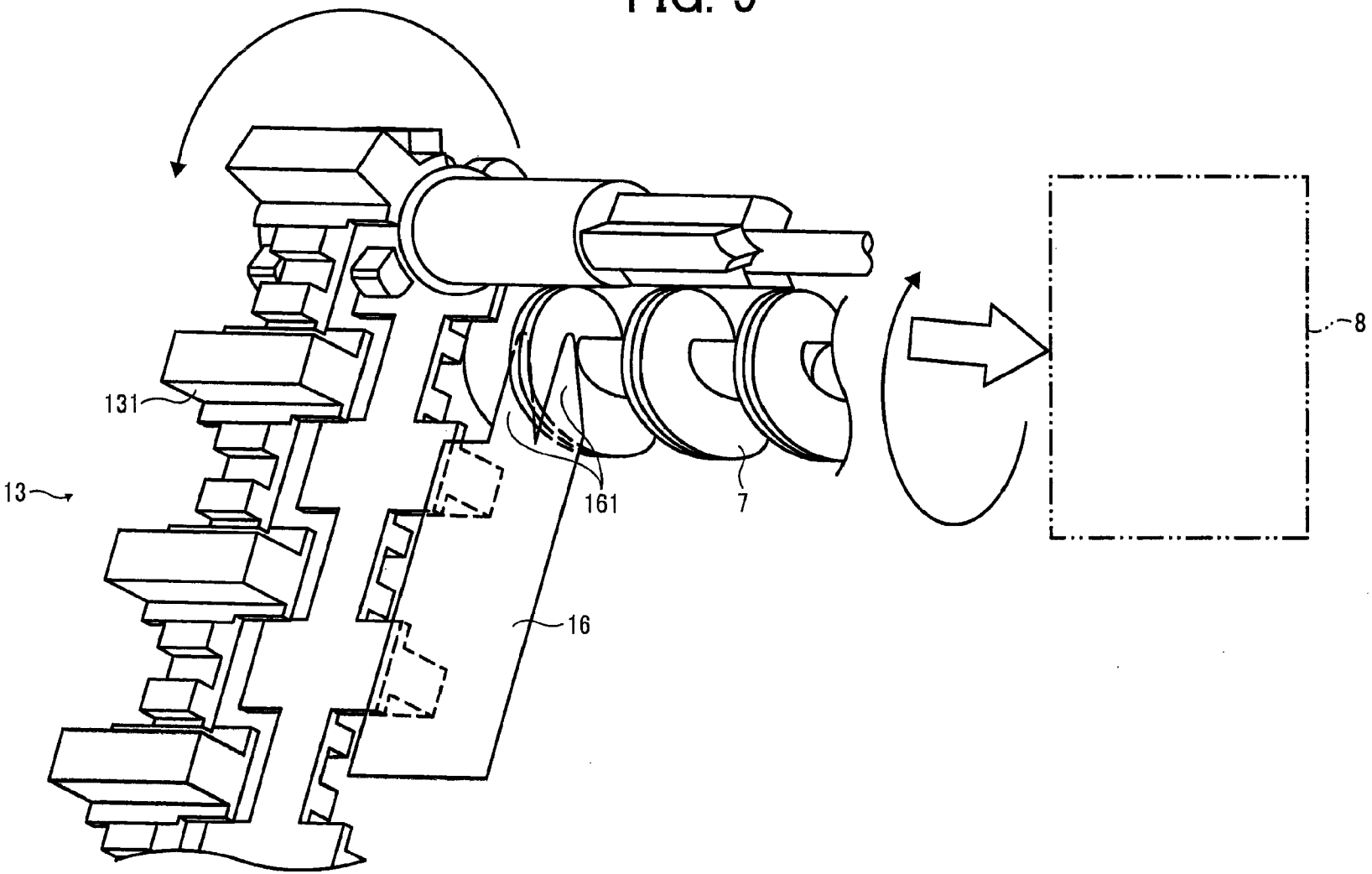
FIG. 5 is a perspective view of an upper end portion of the waste-toner collecting device shown in FIG. 3.

Specifically, as shown in FIG. 5, two spatular convex portions 161 are formed at a tip of the toner scraping member 16. The spatular convex portions 161 are in contact with the waste-toner conveying screw 7 so as to scrape off toner stuck on the waste-toner conveying screw 7. Therefore, for example, even when toner degrades with long-term use, i.e., toner prone to be stuck on the waste-toner conveying screw 7 is used, the toner can be removed from the waste-toner conveying screw 7 reliably. Namely, the waste-toner conveying screw 7 can reliably convey waste toner regardless of whether the toner is the new one or the degraded one.

The spatular convex portions 161 are formed to have the pitch shorter than that of the waste-toner conveying screw 7. Therefore, one of blades of the waste-toner conveying screw 7 is just sandwiched between the spatular convex portions 161, so that both sides of the blade can be in contact with the spatular convex portions 161. Thus, waste toner can be removed from the blade of the waste-toner conveying screw 7 reliably.

Figure 6:
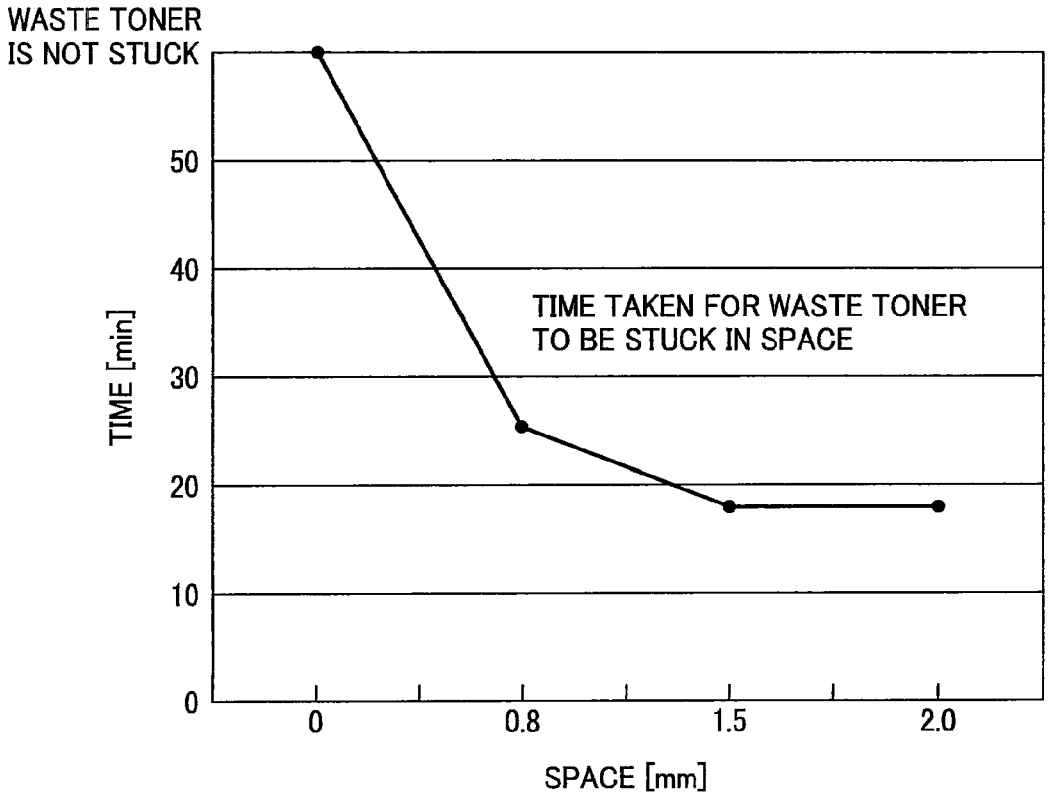
FIG. 6 is a graph showing a relation between a width of a gap between a waste-toner conveying screw and a body of the waste-toner collecting device and a time taken for waste toner to be stuck in the gap.

FIG. 6 is a graph showing a relation between a distance of the gap between the upper waste-toner conveying screw 7 and the inner wall of the body 14 and a time taken for waste toner to be stuck in the gap. As shown in the graph, when the distance is in a range of 0.8 millimeter (mm) to 2.0 mm, waste toner is stuck in the gap after a lapse of around twenty minutes. However, in the present embodiment, there is no gap between the upper waste-toner conveying screw 7 and the inner wall of the body 14, so that it never happens that waste toner is stuck.

Figure 7:
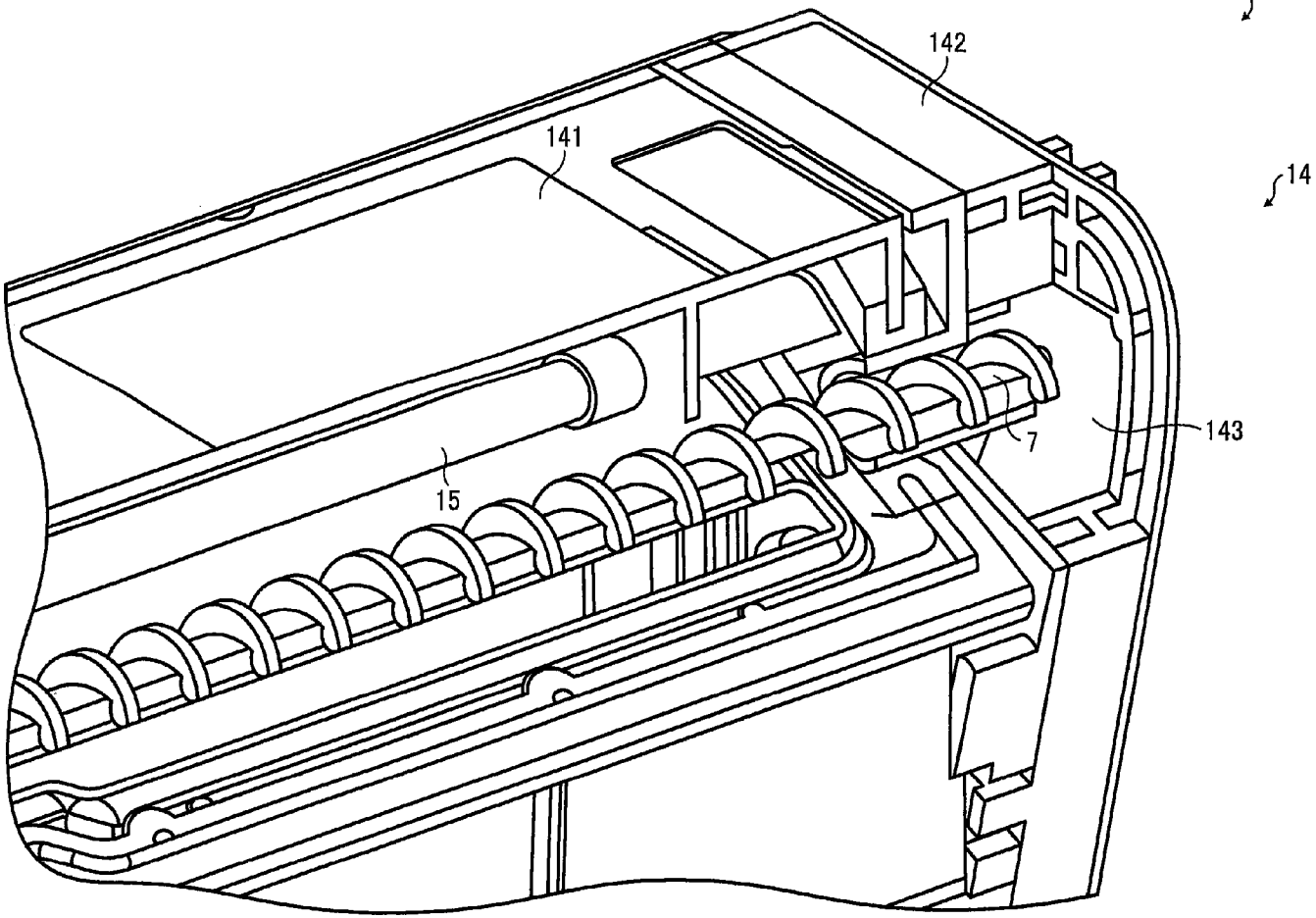
FIG. 7 is a perspective view of a waste-toner collecting device according to a second embodiment of the present invention.
Figure 8:
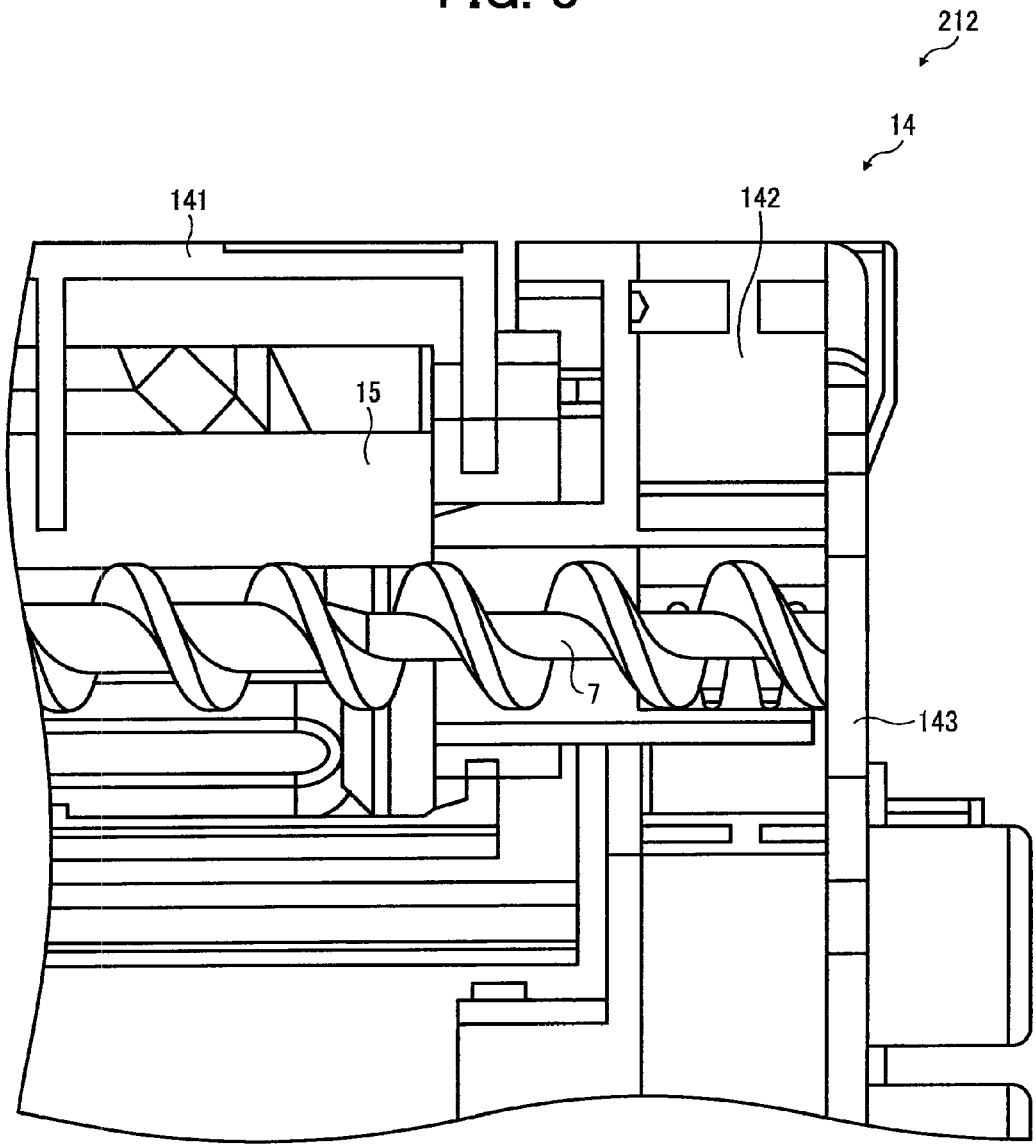
FIG. 8 is a side view of a portion of the waste-toner collecting device shown in FIG. 7 on one side thereof.
Figure 9:
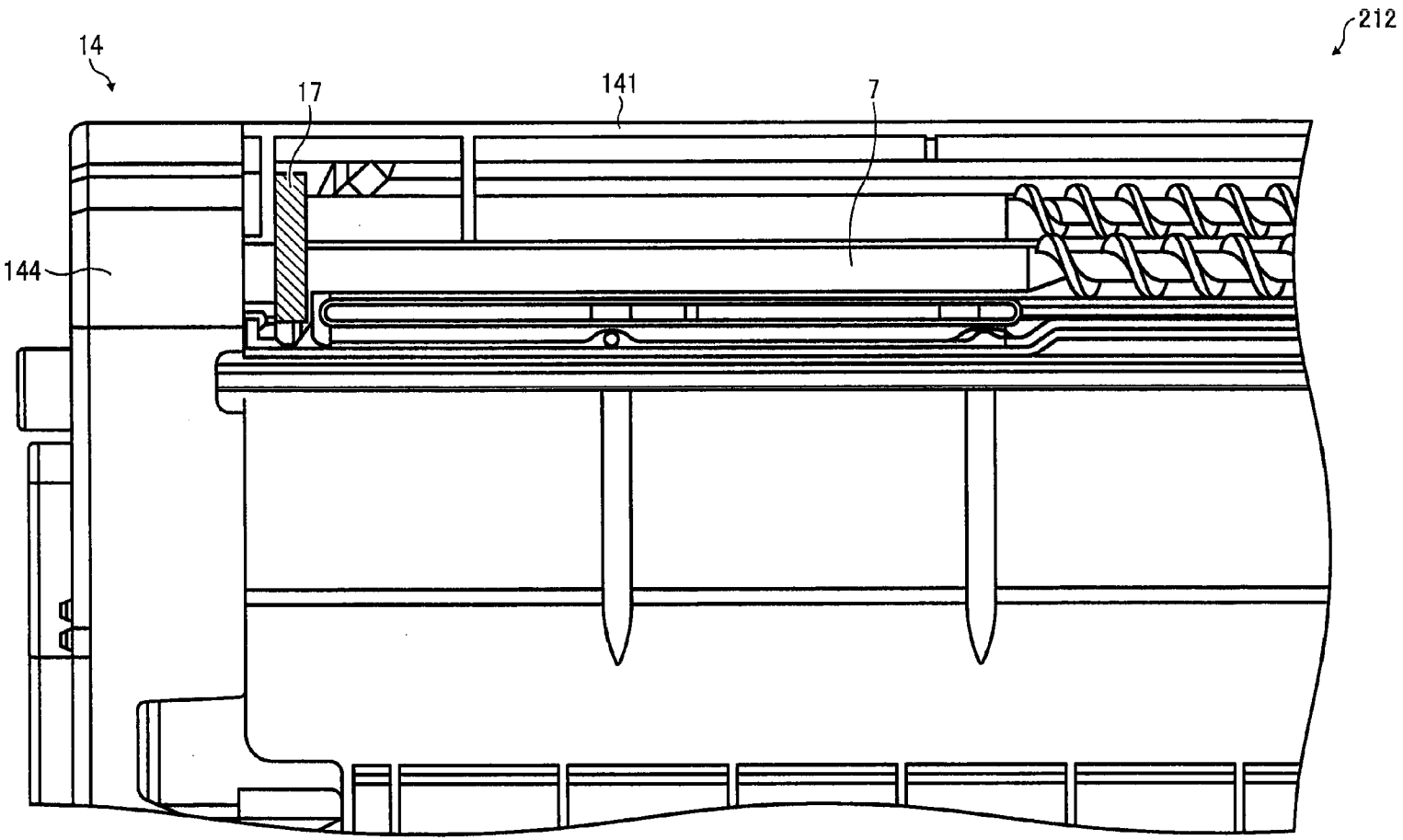
FIG. 9 is a side view of a portion of the waste-toner collecting device shown in FIG. 7 on the other side thereof.

FIG. 7 is a perspective view of a waste-toner collecting device 212 according to a second embodiment of the present invention. FIG. 8 is a side view of a portion of the waste-toner collecting device 212 on one side thereof. FIG. 9 is a side view of a portion of the waste-toner collecting device 212 on the other side thereof. The portions identical to those for the first embodiment are denoted with the same reference numerals, and the description of those portions is omitted. In the second embodiment, the body 14 of the waste-toner collecting device 212 is composed of a plurality of removable separate parts. For example, each of the separate parts is fixed by a bolt so that the separate part can be removed by unscrewing the bolt. In this example shown in FIGS. 7 to 9, the body 14 is composed of a first body 141, a second body 142, a third body 143, and a fourth body 144. The first body 141 is a top portion of the body 14. The second body 142 is a top end portion of the body 14, and is adjacent to the first body 141. The third and fourth bodies 143 and 144 are respectively side walls of the body 14. The body 14 is composed of a plurality of such removable separate parts, so that the waste-toner collecting device 212 and thus the image forming apparatus 1 can be easily recycled.

Furthermore, in the present embodiment, as shown in FIG. 9, a pressing member 17 is provided between the inner wall of the body 14 and one end of the upper waste-toner conveying screw 7 on the opposite side to that is shown in FIG. 7. The other end of the upper waste-toner conveying screw 7 on the right side in FIGS. 8 and 9 (i.e., on the side of the third body 143) is pressed against an inner wall of the third body 143 so as to be in abutting contact with the inner wall of the third body 143. Therefore, even when a length of the upper waste-toner conveying screw 7 is not long enough, it is possible to eliminate the gap between the end of the upper waste-toner conveying screw 7 and the inner wall of the body 14. In addition, an accuracy of the length of the upper waste-toner conveying screw 7 can be relaxed.

Incidentally, in the first embodiment, the waste-toner container 8 made of hard resin is employed. A portion of the body 14 can be made of a flexible material. In this case, when the waste-toner container 8 is filled up with the waste toner, a wall of the body 14 can be transformed to increase a volumetric capacity so that the waste-toner container 8 can contain therein a larger amount of waste toner.

Figure 10:
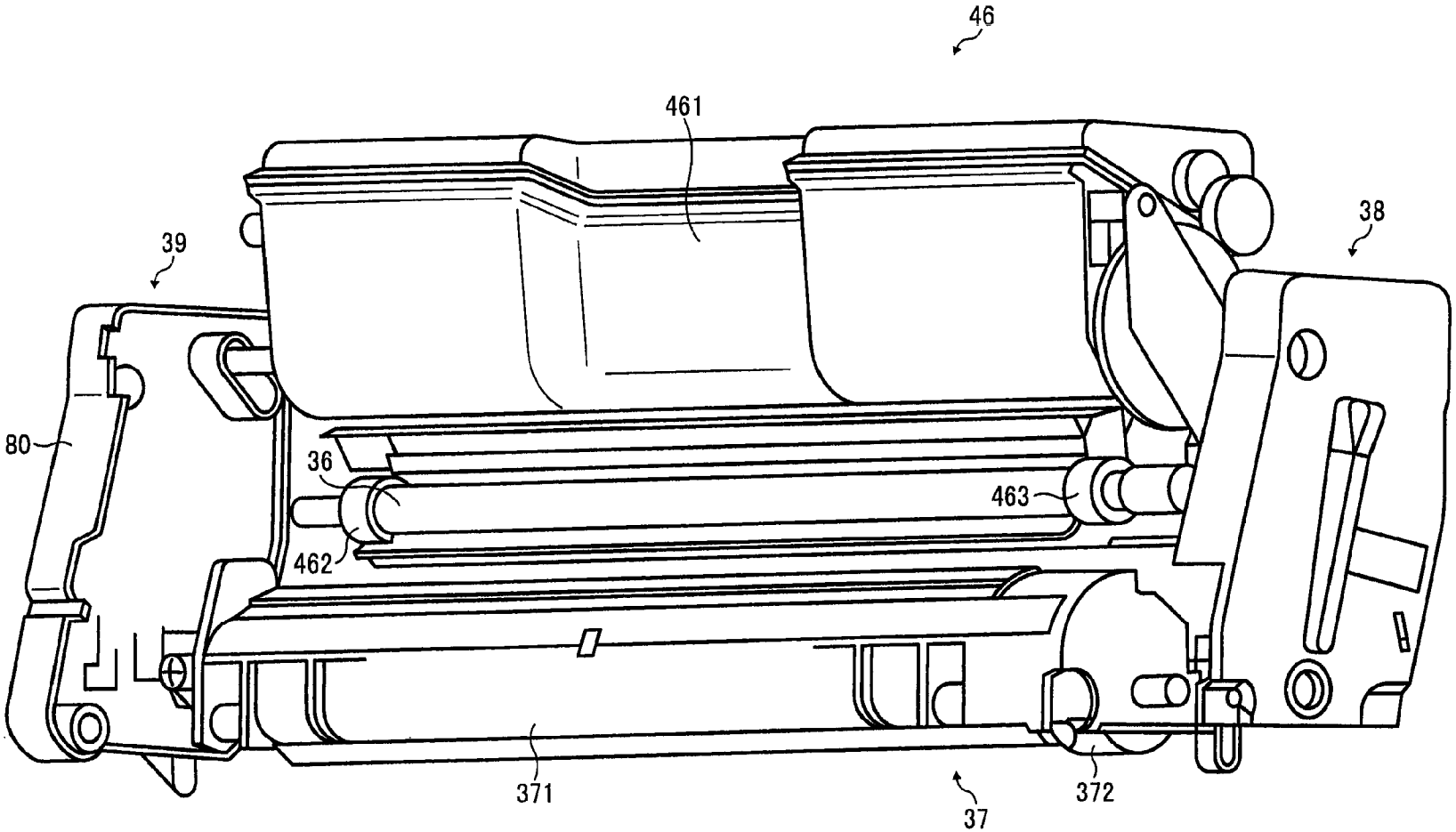
FIG. 10 is a schematic diagram of a process cartridge including a waste-toner collecting device according to a third embodiment of the present invention.

FIG. 10 depicts an example of a process cartridge including a waste-toner collecting device according to a third embodiment of the present invention. The process cartridge is composed of a developing unit 46, a photoreceptor unit 37, a left side plate 38, and a waste-toner conveying unit 39 as the waste-toner collecting device according to the third embodiment. The waste-toner conveying unit 39 doubles as a right side plate of the process cartridge. The left side plate 38 and the waste-toner conveying unit 39 support the developing unit 46 and the photoreceptor unit 37 by holding the developing unit 46 and the photoreceptor unit 37 from both sides, for example, in convexo-concave engagement. The waste-toner conveying unit 39 includes a waste-toner conveying belt (not shown) and a housing 80. The waste-toner conveying belt is housed in the housing 80. When waste toner is conveyed from the photoreceptor unit 37, the waste-toner conveying unit 39 conveys the waste toner upward with the waste-toner conveying belt so as to convey the waste toner to the developing unit 46.

In the developing unit 46, both sides of a developing roller 36 are supported by first bearings 462 and 463, respectively. The first bearings 462 and 463 are respectively attached to side surfaces of a housing 461 of the developing unit 46. The first bearings 462 and 463 respectively support portions of the developing roller 36 at a predetermined distance from both ends of a shaft of the developing roller 36 on the inner side. For example, a length of the housing 461 is 268 mm, a length of the shaft is 300 mm, and the distance from each end of the shaft to each of the first bearings 462 and 463 is 30 mm. Likewise, in the photoreceptor unit 37, both sides of a photosensitive drum (not shown) are supported by first bearings 372 (for the sake of convenience, only the first bearing 372 on the side of the left side plate 38 is shown in FIG. 10). The first bearings 372 are respectively attached to side surfaces of a housing 371 of the photoreceptor unit 37. The first bearings 372 respectively support portions of the photosensitive drum at a predetermined distance from both ends of a shaft of the photosensitive drum on the inner side. For example, a length of the housing 371 is 285 mm, a length of the shaft is 315 mm, and the distance from each end of the shaft to each of the first bearings 372 is 25 mm.

Figure 11:
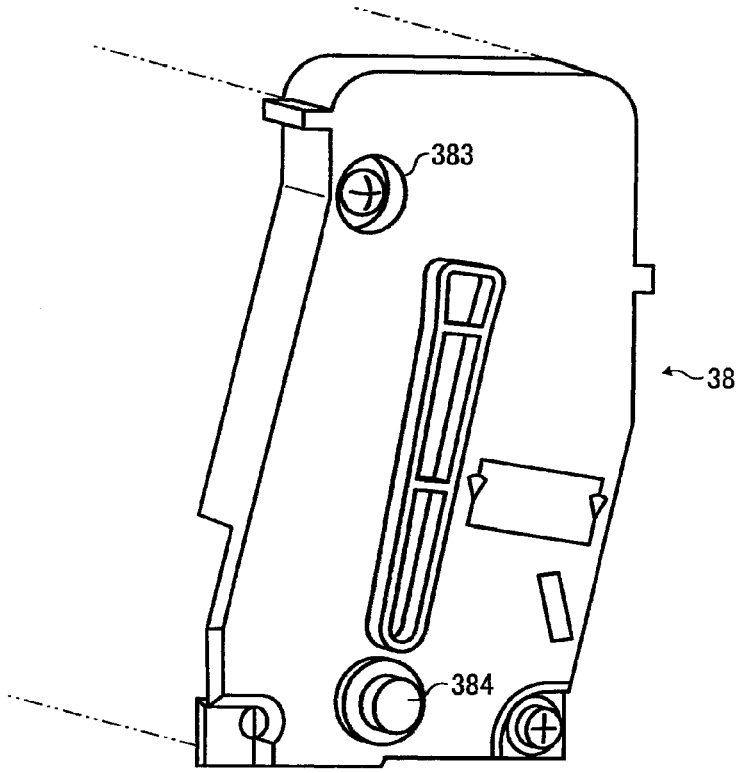
FIG. 11 depicts front and rear perspective views of a left side plate included in the process cartridge.
Figure 11:
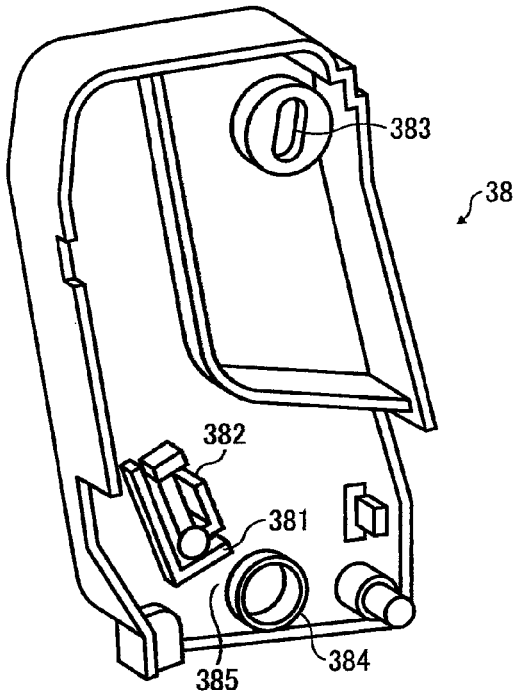
Figure 12:
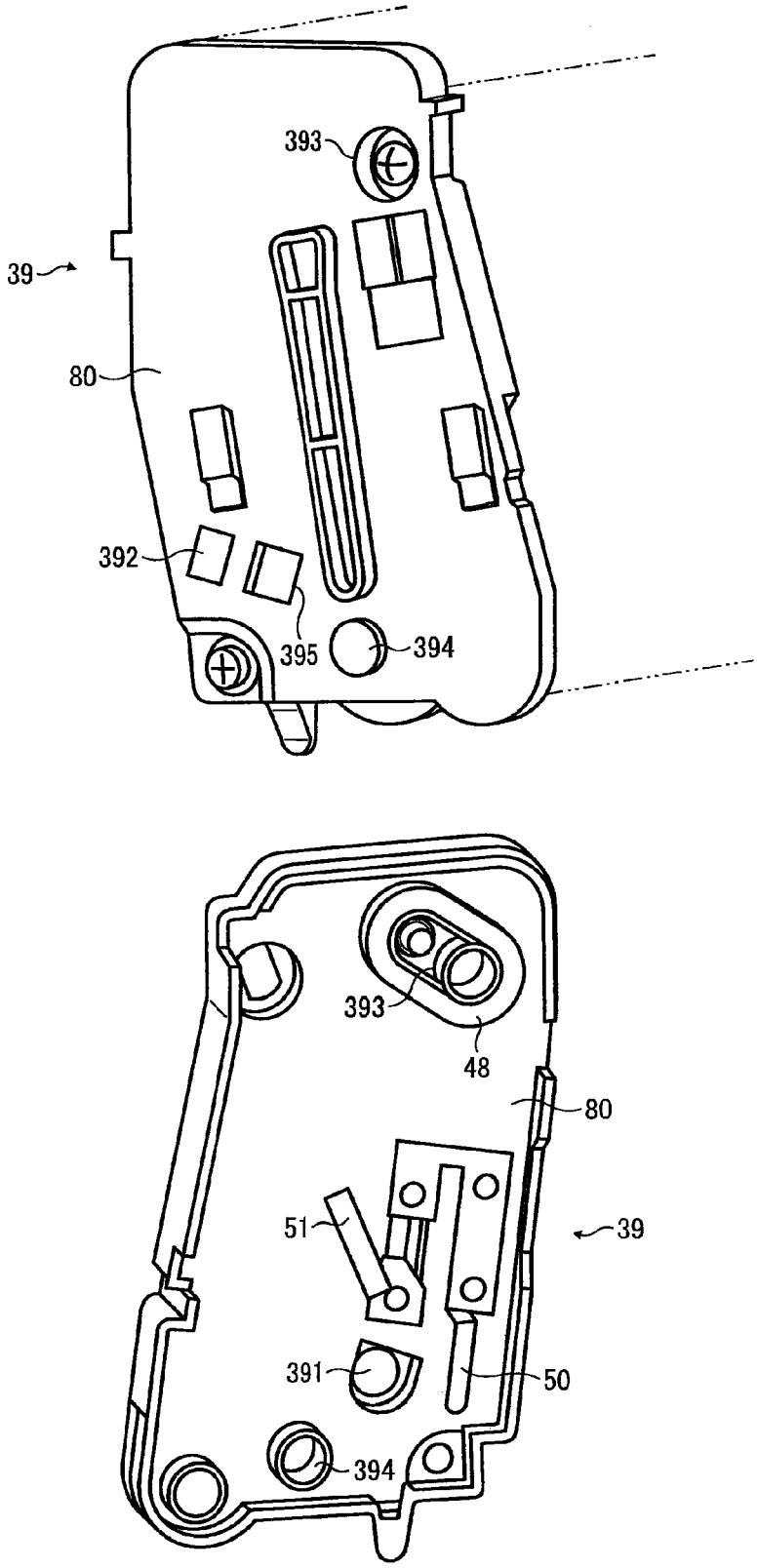
FIG. 12 depicts front and rear perspective views of a waste-toner conveying unit included in the process cartridge.

As shown in FIGS. 11 and 12, second bearings 381 and 391 and third bearings 384 and 394 are formed on the left side plate 38 and the waste-toner conveying unit 39, respectively. The second bearings 381 and 391 respectively support the ends of the shaft of the developing roller 36. The third bearings 384 and 394 respectively support the ends of the shaft of the photosensitive drum. Furthermore, pressing springs 382 and 392 are respectively attached to the left side plate 38 and the waste-toner conveying unit 39 so that the developing roller 36 is pressed against the photosensitive drum via the second bearings 381 and 391. Incidentally, the pressing spring 392 is housed in the housing 80 of the waste-toner conveying unit 39. By such a configuration, the second bearings 381 and 391 can be displaced in a direction of the photosensitive drum.

Figure 13:
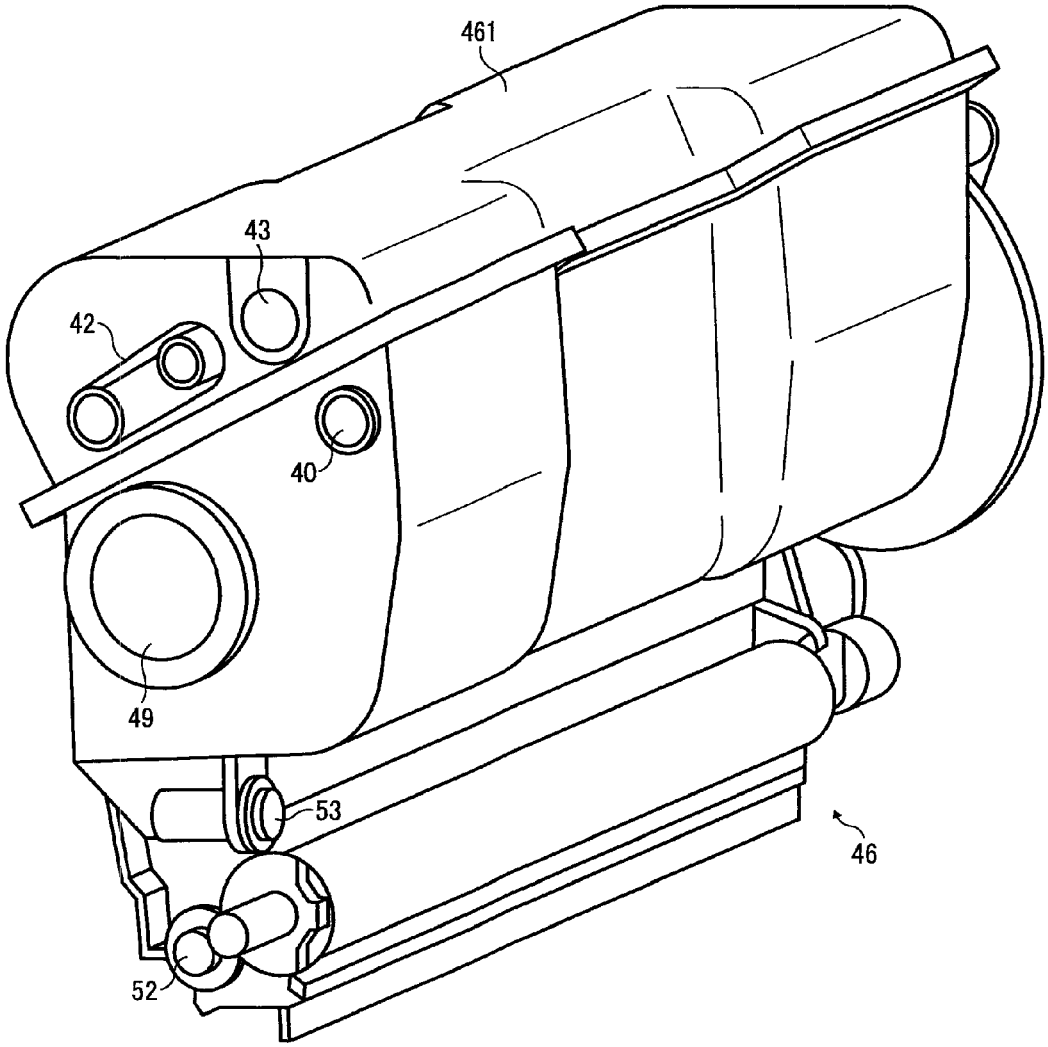
FIG. 13 is a perspective view of a developing unit included in the process cartridge viewed from one side thereof.
Figure 14:
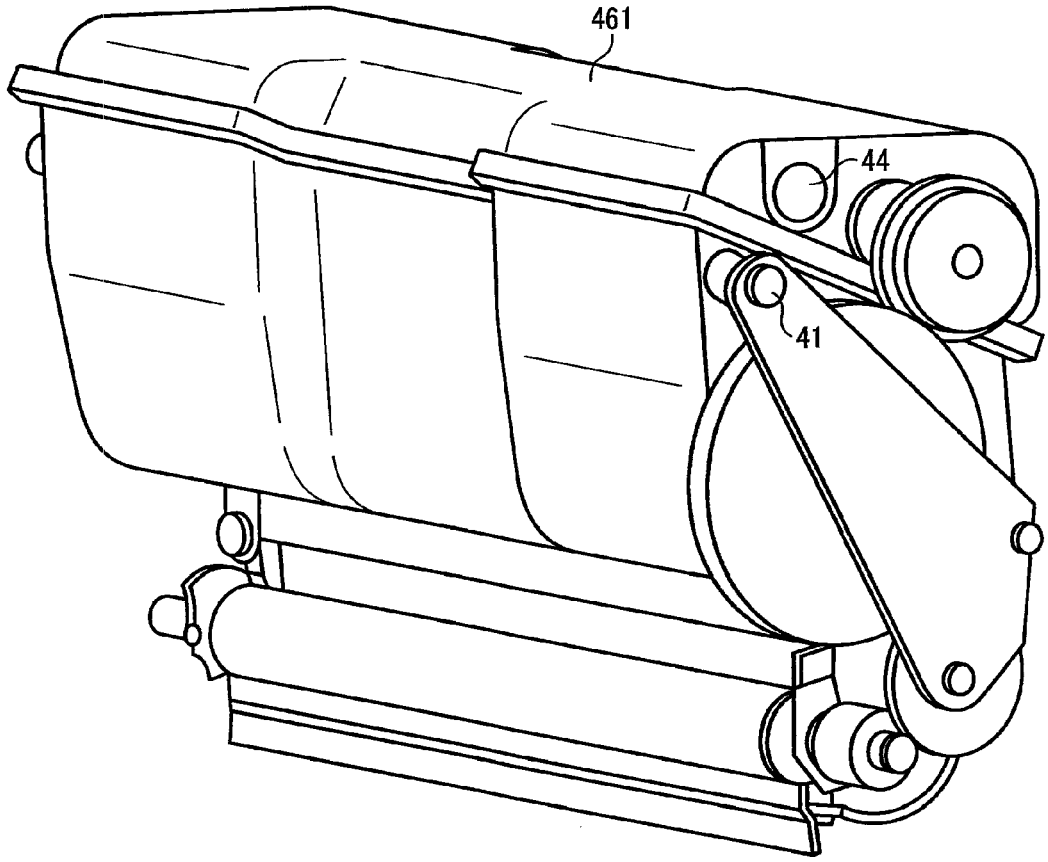
FIG. 14 is a perspective view of the developing unit shown in FIG. 13 viewed from the other side thereof.

As shown in FIGS. 13 and 14, bosses 40 and 41 are formed on upper portions of the side surfaces of the housing 461, respectively. On the other hand, as shown in FIG. 11, a sliding engagement portion 383 in a shape of a long hole is formed on the left side plate 38. As shown in FIG. 12, a sliding engagement portion 393 in a shape of a long hole is formed on the waste-toner conveying unit 39. By this configuration, when the developing unit 46 is held by the left side plate 38 and the waste-toner conveying unit 39, the housing 461 is slidably supported by the left side plate 38 and the waste-toner conveying unit 39. A direction of the long axis of the sliding engagement portion formed in a shape of a long hole is substantially coincident with a direction of action of the pressing spring, whereby the developing roller 36 can be easily moved away from the photosensitive drum. In such a configuration, for example, a wedge stuffing is put in each of positions 385 (see FIG. 11) and 395 (see FIG. 12) of the second bearings 381 and 391 on the opposite side of the pressing springs 382 and 392, so that the developing roller 36 can be easily moved away from the photosensitive drum in shipping. Thus, it is possible to prevent a plastic deformation occurred due to continuous pressure by the developing roller 36. Incidentally, in FIG. 12, a reference numeral 48 denotes a sealing member, a reference numeral 50 denotes a terminal for a toner replenishing roller, and a reference numeral 51 denotes a terminal for a developing blade.

Incidentally, as shown in FIG. 13, an opening for filling a new toner is formed on the side surface of the housing 461 on the side where the boss 40 is formed. The opening is covered with a cap 49 so as to prevent toner leakage after the toner is filled up. Furthermore, a waste-toner carrying-in entrance 42 is formed on the side surface on which the opening and the boss 40 are formed. The waste toner conveyed by the waste-toner conveying unit 39 is collected in a waste-toner collection chamber via the waste-toner carrying-in entrance 42. The waste-toner carrying-in entrance 42 is provided on the same surface as the opening for filling a new toner, so that it is possible to prevent the waste toner from leaking from the waste-toner carrying-in entrance 42 when a new toner is filled up again. Furthermore, the process cartridge is composed of the four separate parts, whereby the opening is covered with the waste-toner conveying unit 39 from the outside. Therefore, when a new process cartridge is attached to the image forming apparatus, it is possible to prevent a user from touching the cap 49 accidentally, and thus, it is possible to prevent occurrence of toner leakage due to a fall of the cap 49. Incidentally, waste-toner vacuum holes 43 and 44 are respectively formed on the both side surfaces of the housing 461. Each of the waste-toner vacuum holes 43 and 44 is sealed by a sealing member. Incidentally, in FIG. 13, a reference numeral 52 denotes a shaft end of the toner replenishing roller, and a reference numeral 53 denotes an end of the developing blade.

According to an aspect of the present invention, an end of a waste-toner conveying screw on the side of a waste-toner conveying belt is rotatably supported by an inner wall of a body of a waste-toner collecting device in a state where the end of the waste-toner conveying screw is in contact with the inner wall. In other words, there is no gap between the end of the waste-toner conveying screw and the inner wall of the body. Therefore, it is possible to solve such a conventional problem that waste toner is prone to accumulate in the gap between the end of the waste-toner conveying screw and the inner wall of the body. Thus, it is not necessary to provide a striking member as in the conventional technology, so that it is possible to prevent waste toner from accumulating in the gap between the end of the waste-toner conveying screw and the inner wall of the body without increasing a size of the waste-toner collecting device or applying an impact force to the waste-toner collecting device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A waste-toner collecting device comprising:

a cleaning unit that collects waste toner remaining on an image carrier;

a conveying belt that conveys the waste toner collected by the cleaning unit in a first direction; and a conveying screw that conveys the waste toner conveyed by the conveying belt in a second direction, wherein an end of the conveying screw on a side of the conveying belt is rotatably supported by an inner wall of a body of the waste-toner collecting device in a state where the end of the conveying screw is in direct contact with the inner wall.

2. The waste-toner collecting device according to claim 1, wherein the end of the conveying screw is in contact with the inner wall while being pressed against the inner wall.

3. The waste-toner collecting device according to claim 1, wherein the conveying screw includes a scraping member that scrapes off waste toner stuck on the conveying screw, and a spatular convex portion is formed at a tip of the scraping member.

4. The waste-toner collecting device according to claim 3, wherein the spatular convex portion includes a plurality of spatular convex sub-portions having a pitch shorter than that of the conveying screw.

5. The waste-toner collecting device according to claim 1, wherein a waste-toner conveying capacity of the conveying belt is larger than a waste-toner collecting capacity of the cleaning unit.

6. The waste-toner collecting device according to claim 1, wherein an axial center of a drive shaft of the conveying screw is located on a lower side of an axial center of a drive shaft of the conveying belt, the drive shaft of the conveying belt being provided on an upper side of the conveying belt.

7. The waste-toner collecting device according to claim 1, wherein the body of the waste-toner collecting device is composed of a plurality of removable separate parts.

8. The waste-toner collecting device according to claim 1, wherein the body of the waste-toner collecting device is made of a flexible material.

9. A process cartridge comprising a waste-toner collecting device including:

a cleaning unit that collects waste toner remaining on an image carrier;

a conveying belt that conveys the waste toner collected by the cleaning unit in a first direction; and a conveying screw that conveys the waste toner conveyed by the conveying belt in a second direction, wherein an end of the conveying screw on a side of the conveying belt is rotatably supported by an inner wall of a body of the waste-toner collecting device in a state where the end of the conveying screw is in direct contact with the inner wall.

10. An image forming apparatus comprising a waste-toner collecting device including:

a cleaning unit that collects waste toner remaining on an image carrier;

a conveying belt that conveys the waste toner collected by the cleaning unit in a first direction; and a conveying screw that conveys the waste toner conveyed by the conveying belt in a second direction, wherein an end of the conveying screw on a side of the conveying belt is rotatably supported by an inner wall of a body of the waste-toner collecting device in a state where the end of the conveying screw is in direct contact with the inner wall.

* * * * *